United States Patent [19]

Suzuki et al.

[11] Patent Number: 4,988,312

[45] Date of Patent: Jan. 29, 1991

[54] COAXIAL CONNECTOR FOR CONNECTING COAXIAL CABLE CONTACTS WITH PRINTED CIRCUIT BOARDS

[75] Inventors: Takao Suzuki; Katsumi Takekawa; Tetsuro Tokaichi; Shoji Umesato, all of Tokyo, Japan

[73] Assignees: Japan Aviation Electronics Industry, Limited; NEC Corporation, both of Japan

[21] Appl. No.: 504,584

[22] Filed: Apr. 4, 1990

[30] Foreign Application Priority Data

Apr. 6, 1989 [JP] Japan ..... 1-39977[U]

[51] Int. Cl.[5] ..... H01R 4/66

[52] U.S. Cl. ..... 439/581

[58] Field of Search ..... 439/578–585

[56] References Cited

U.S. PATENT DOCUMENTS 4,396,242 8/1983 Kurano et al. ..... 439/581
4,605,269 8/1986 Cohen et al. ..... 439/581
4,713,024 12/1987 Hatakeyama et al. ..... 439/581

*Primary Examiner*—Joseph H. McGlynn

*Attorney, Agent, or Firm*—Laff, Whitesel, Conte & Saret

[57] ABSTRACT

A coaxial connector comprising a first insulator (29), a second insulator (31), and a straight-line contact (21) disposed between the first and second insulators is disclosed. The straight-line contact comprises a first conductive plate and a second conductive plate, which are superimposedly combined, wherein each of the first and second conductive plates includes a first contact (25), a second contact (27), and a base plate (23) from which the first and second contacts extend in the same directions, thus including a pair of the base plates. The first contact and the second contact are arranged alternately in parallel rows in the longitudinal direction of the base plate. The first insulator comprises, on the side facing the second insulator, a groove (49) for accommodating the end portions of the first and second contacts for supporting thereof, and a guide means for guiding a mating element which is to be connected to the straight-line contact. The second insulator includes, on the side facing the first insulator, a pair of grooves for accommodating the base plate for each of the first contact and the second contact.

8 Claims, 4 Drawing Sheets

COAXIAL CONNECTOR FOR CONNECTING COAXIAL CABLE CONTACTS WITH PRINTED CIRCUIT BOARDS

BACKGROUND OF THE INVENTION (1) Field of the Invention

The present invention relates to a coaxial connector for electrically connecting coaxial cable contacts with printed circuit boards, and in particular, to a coaxial connector which is particularly improved in that the assembling is easily and quickly accomplished without error, and free from the problems such as the bending or buckling of the contacts of the connector, and there is no necessity for press fitting of the contacts when assembling thereof.

(2) Description of The Prior Art

A conventional coaxial connector for electrically connecting coaxial cable contacts with printed circuit boards comprises a first or upper insulator member, a second or lower insulator and a straight-line contact interposed between the first and second insulator members. The straight-line contact comprises two conductive plates superimposedly combined to form a contact member. The contact member, however, includes a number of separated contact end portions to be inserted into the accommodating holes formed in the second insulator. The separated end portions of the contact member are not always in such exact alignment as to be smoothly fitted into the respective accommodating holes. Therefore, the assembling is not easy and the bending or buckling of the contacts is apt to occur when assembled as will be described in more detail later.

SUMMARY OF THE INVENTION

It is therefore an object of the present invention to provide a coaxial connector for connecting coaxial cable contacts with printed circuit boards wherein when a straight-line connector is assembled with the insulators, a press fitting is not required, and, also, the connector is easily and accurately fitted into the right position in the insulators without special tools, and causing no problems such as bending and buckling of the contact as in the conventional straight-line contact.

According to this invention, there is provided with a coaxial connector comprising a first insulator, a second insulator facing the first insulator in a first predetermined direction, a contact member disposed between the first and the second insulators, and guide means for guiding a mating element which is to be connected to the contact member. The first insulator has a first principal surface. The second insulator has a second principal surface which is opposite to the first principal surface in the first predetermined direction. The contact member comprises a first and a second conductive plate which are superimposedly combined. In the coaxial connector, each of the first and the second conductive plates includes a base plate extending in a second predetermined direction which is perpendicular to the first predetermined direction, and a first and a second contact extending from the base plate perpendicular to the second predetermined direction. The first and the second contacts are arranged alternately in parallel rows in the second predetermined direction. The first insulator has, on the first principal surface, a first groove extending in the second predetermined direction. The second insulator has, on the second principal surface, a pair of second grooves extending in the second predetermined direction. The first and the second contacts have end portions which are collectively accommodated in the first groove. Each base plate of the first and the second conductive plates is accommodated in each of the second grooves.

DESCRIPTION OF THE PREFERRED EMBODIMENTS

Figure 3:
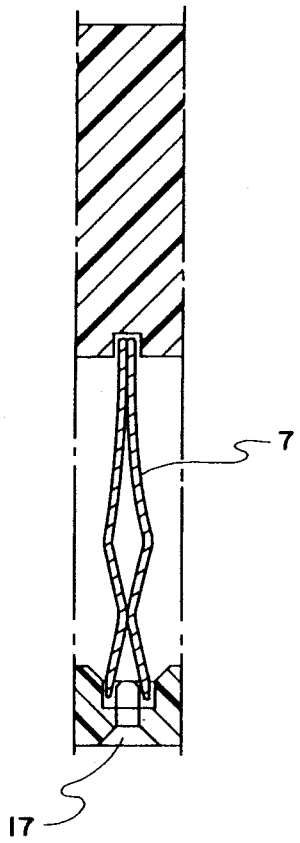
FIG. 3 (PRIOR ART)
FIG. 3 is a sectional view taken along line III—III in FIG. 1.
Figure 2:
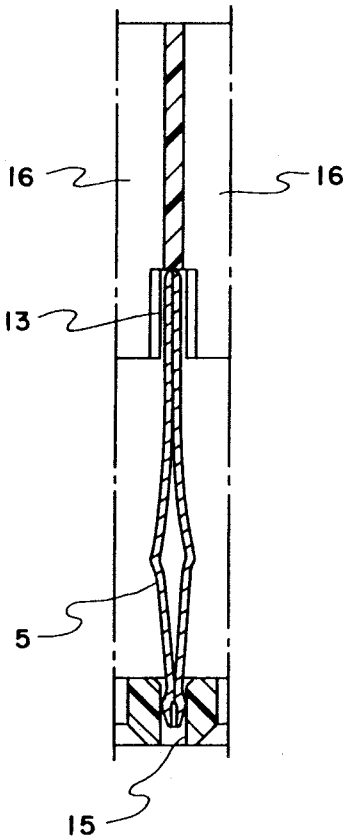
FIG. 2 (PRIOR ART)
FIG. 2 is a sectional view taken along line II—II in FIG. 1.
Figure 1:
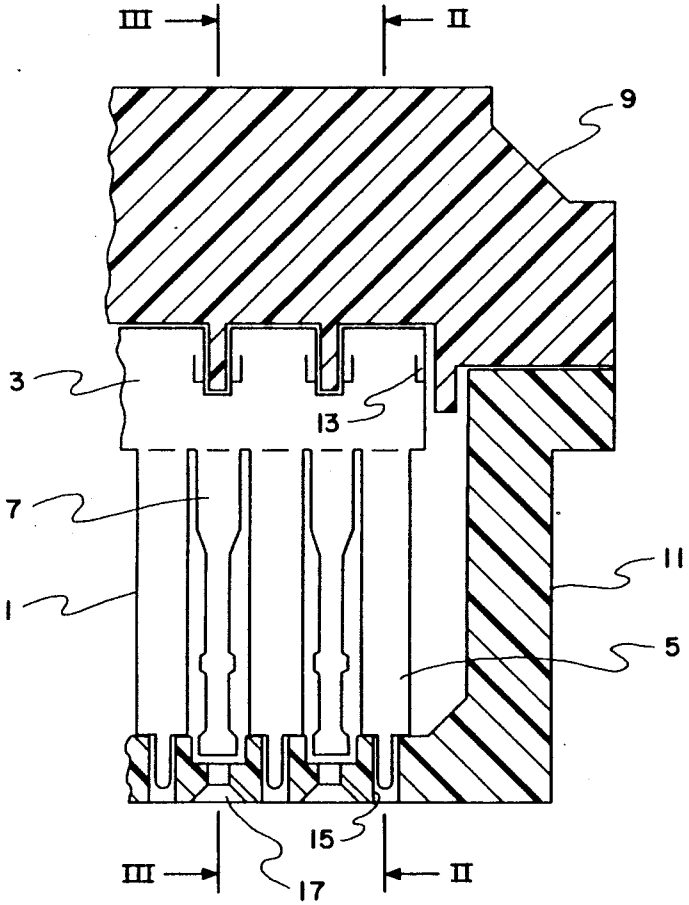
FIG. 1 (PRIOR ART)
FIG. 1 is a cross-sectional view of a convectional coaxial connector.

Referring to FIGS. 1 to 3, a conventional coaxial connector for electrically connecting coaxial cable contacts with printed circuit boards will be described at first for a better understanding of the present invention.

This coaxial connector comprises two conductive plates superimposedly combined to form a straight-line contact 1 as a contact member. The straight-line contact 1 comprises a two-plate support section 3, and a first contact 5 and a second contact 7, each of which is resilient and extends from one side of the support section 3. The function of the first contact 5 is to make contact with a coaxial cable contact (not shown). The function of the second contact 7 is to make contact with a ground pin of a pin header on a printed circuit board.

The first and second contacts 5 and 7 are arranged alternately in rows in the longitudinal direction of the support section 3. Each straight-line contact 1 is secured between a first or upper insulator member 9 and a second or lower insulator 11. The upper and the lower insulators 9 and 11 have a first and a second principal surfaces which are opposite to each other. A press fit section 13 formed at an end section of the support section 3 is inserted by press fitting into the grooves formed in the upper insulator 9. The first and second contacts 5 and 7 are inserted into the separate holes formed in the lower insulator 11. A first hole 15, into which the first contact 5 is fitted to contact an outer conductive body of a coaxial cable connector, and a second hole 17, into which a ground pin is fitted to contact the second contact 7, are formed in the bottom surface of the lower insulator 11.

At the lower end of the first contact 5, specifically, the section which is inserted into the first hole 15 of the lower insulator 11, the two conductive plates which superimposedly make up the first contact 5 are bent inward toward one another as shown in FIG. 2. At the lower end of the second contact 7, specifically, as shown in FIG. 3, the section which is positioned close to the second hole 17 of the lower insulator 11, the two conductive plates which superimposedly make up the second contact 7 are slightly separated to receive a ground pin (not shown).

An outer conductive body of a coaxial cable contact which passes through a hole 16 in the upper insulator 9 is inserted between the rows of the first contact 5 and comes into contact with the first contact 5.

In the above explained coaxial connector, however, because the straight-line contact 1 must be press fitted into the upper insulator 9, a special tool for press fitting of the straight-line contact 1 is required.

Also, after press fitting of the press fit section 13 of the straight-line contact 1 into the upper insulator 9, the lower insulator is inset. However, in this conventional coaxial connector, the end portions of the first and second contacts 5 and 7 of the straight-line contact 1 are not always in such exact alignment as to be smoothly fitted into the respective holes 15 and 17, because the first and second contacts 5 and 7 themselves are flexible and resilient, and the end portions of the first and second contacts 5 and 7 are separated at the lower end portions thereof, thereby constitute free ends. Therefore a large number of actions to make the insertions correct are required even if the first and second contacts 5 and 7 are in alignment. Usually, however, it is more likely that the free end portions of the first and second contacts 5 and 7 are out of alignment. This makes it difficult to correctly and quickly fit the free end portions of the first and second contacts 5 and 7 into the respective holes 15 and 17. Also, if the straight-line contact 1 is inserted without being properly positioned, it is inevitable that bending and buckling of the first and second contacts 5 and 7 occurs.

Referring to FIGS. 4 to 9, a coaxial connector according to an embodiment of the present invention will now be described below.

The coaxial connector shown in these figures comprises two conductive plates superimposedly combined to form a straight-line contact 21 as a contact member. Each of the conductive plates of the straight-line contact 21 comprises a base plate 23, and a first contact 25 and a second contact 27, each of which extends from one side of the base plate 23 in the same direction. The first and second contacts 25 and 27 are arranged alternately in parallel rows in the longitudinal direction of the base plate 23. A plurality of the straight-line contact 21 is positioned between a first or upper insulator 29 and a second or lower insulator 31.

Figure 5:
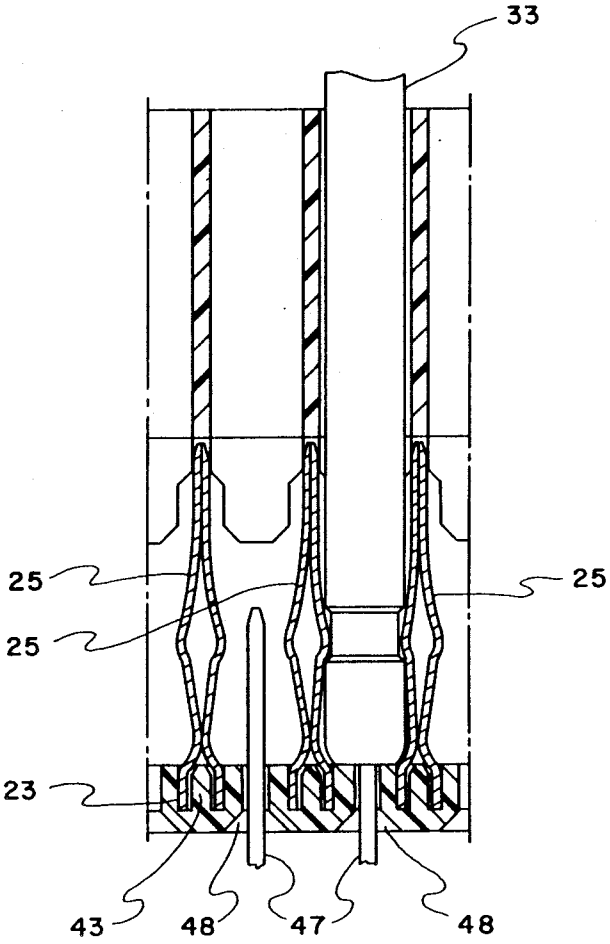
FIG. 5 is a sectional view taken along line V—V in FIG. 4.
Figure 4:
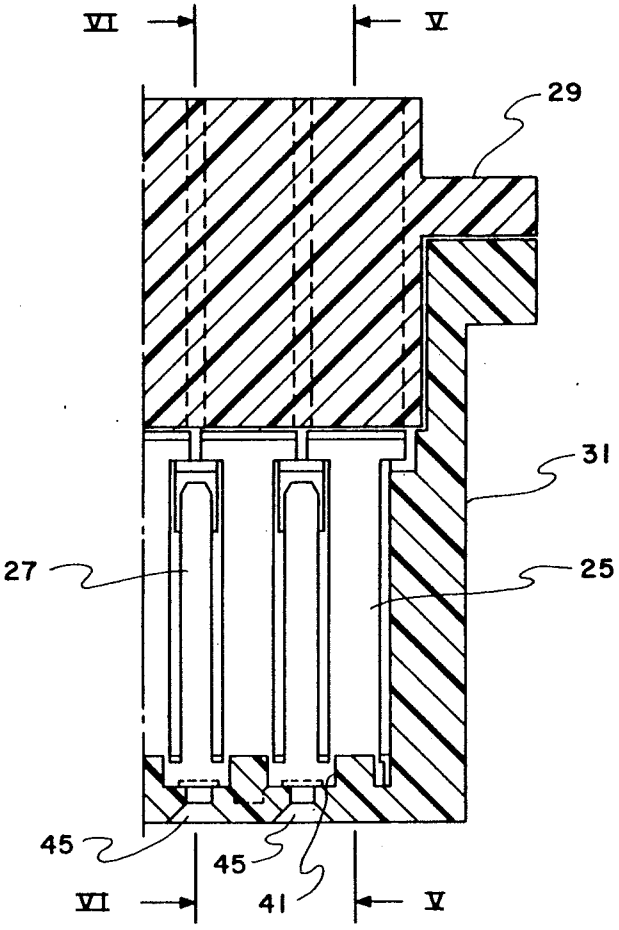
FIG. 4 is a cross-sectional view of the main portion of a coaxial connector according to one embodiment of the present invention.

The first and second contacts 25 and 27 are both resilient. The center section of the first contact 25 is bent outward. As shown in FIG. 5, this center section has the function of making contact with an outer conductive body of a coaxial cable contact 33. The coaxial cable contact 33 has a conventionally known structure and is connected to a coaxial cable (not shown). A support section 35 is formed at the top of the first contact 25, that is, at the end opposite to the base plate 23.

Figure 6:
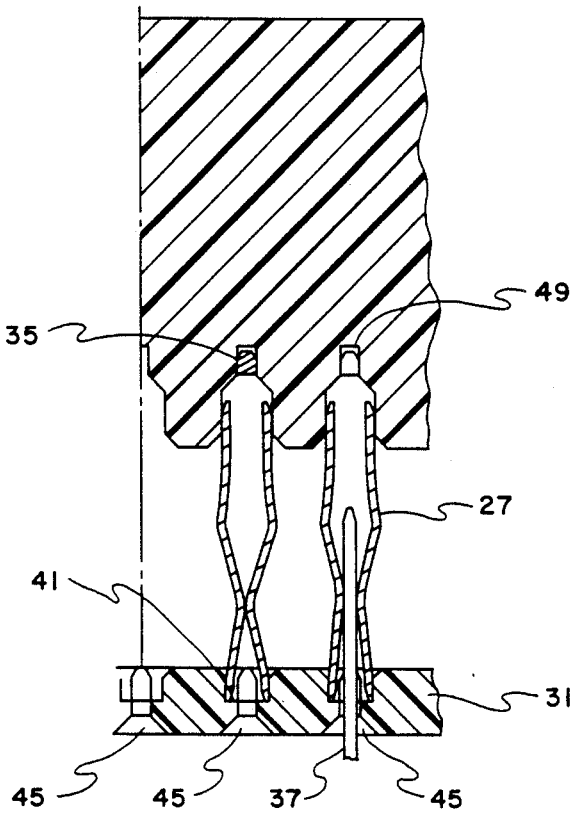
FIG. 6 is a sectional view taken along line VI—VI in FIG. 4.
Figure 8:
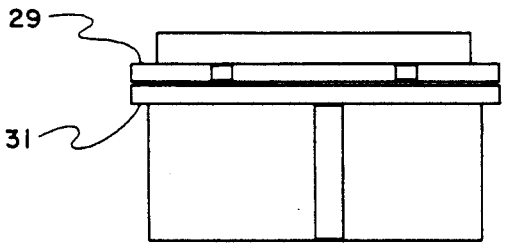
FIG. 8 is a front view of the coaxial connector in FIG. 4.
Figure 9:
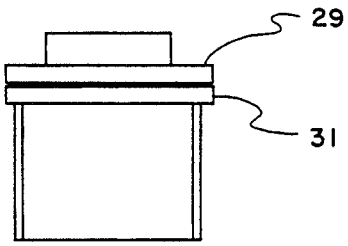
FIG. 9 is a side view of the coaxial connector in FIG. 4.

The center section of the second contact 27 is bent inward. As shown in FIG. 6, the center section of the second contact 27 has the function of making contact with a ground pin 37. The upper and lower ends of the second contact 27 are separated.

Figure 7:
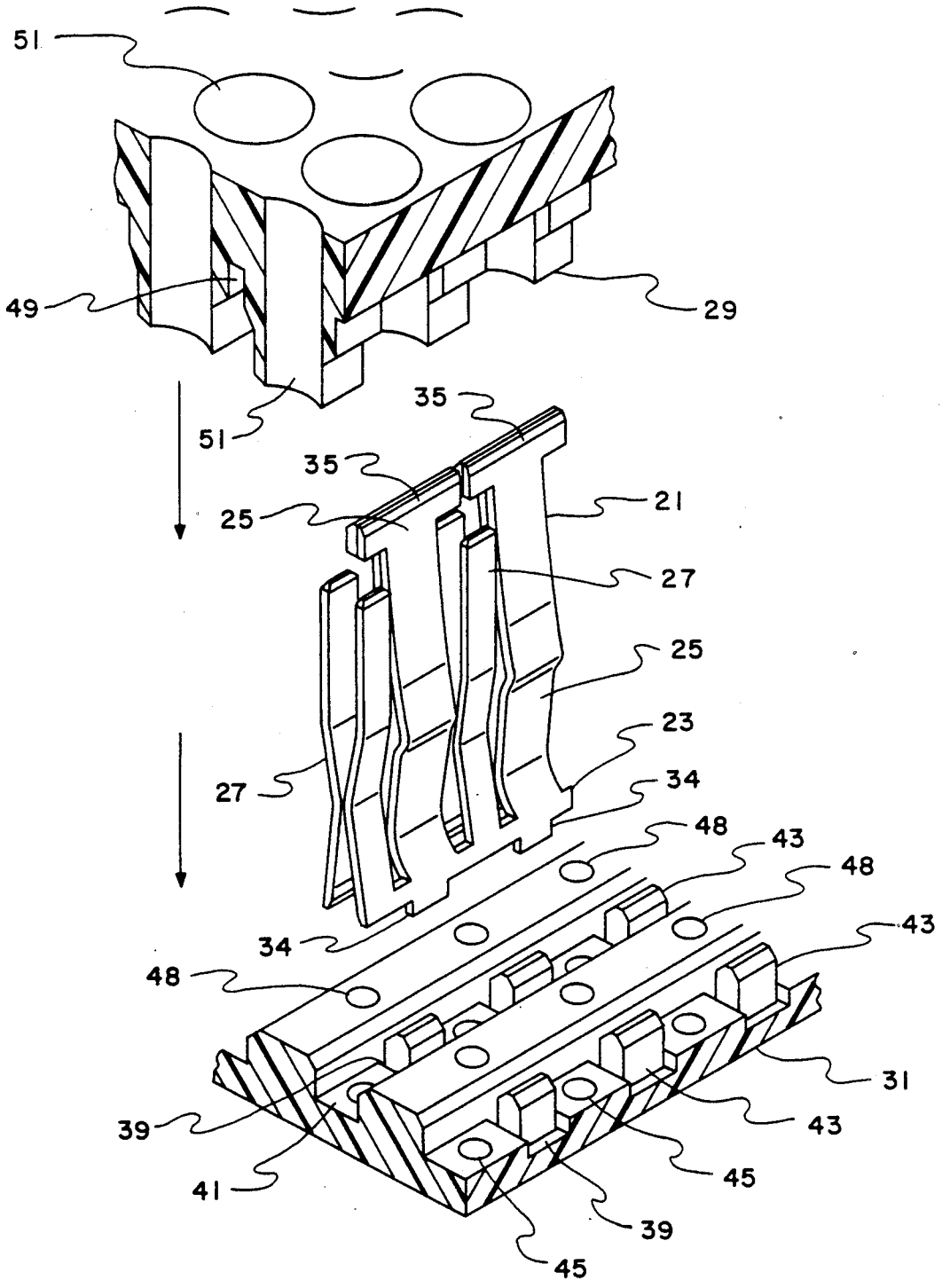
FIG. 7 is an exploded perspective view of the main portion of the coaxial connector in FIG. 4.

An engaging portion 34 is provided at the lower section of the base plate 23 of the first contact 25 as shown in FIG. 7.

An elongated groove 41 for accommodating the straight-line contact 21 is formed in the lower insulator 31 on the side facing the upper insulator 29. The base plates 23 of the straight-line contact 21 are inserted into the elongated groove 41. When this insertion takes place, the engaging portion 34 extending from the base plate 23 is fitted into a depression 39 in the bottom of the elongated groove 41, so that the straight-line contact 21 is prevented from moving along the elongated groove 41.

A plurality of projections 43 are formed in the elongated groove 41 in such a configuration as to be positioned between the pair of base plates 23 of the straight-line contact 21 when the straight-line contact 21 is fitted into the groove 41 of the lower insulator 31. As a result, the projections 43 divide the elongated groove 41 into a pair of grooves which are for accommodating the base plates 23.

A plurality of first holes 45 for insertion of the ground pins 37 are formed at the bottom of the elongated groove 41 between the projections 43.

In addition, a plurality of second holes 48, into each of which a signal pin 47 is inserted, are formed between the adjacent elongated grooves 41.

An elongated groove 49, into which a support section 35 of the first contact 25 and the upper portion of the second contact 27 are supportedly inserted, is formed in the upper insulator 29 on the side facing the lower insulator 31. More specifically, as shown in FIG. 6, the groove 49 is formed to include a narrow and deep portion for accommodating the support section 35 of the first contact 25 and a wide and shallow portion for accommodating the upper portion of the second contact 27. Further, a third hole 51 is formed for insertion of the coaxial cable contact 33 to the point where it makes contact with the first contact 25 is formed in the upper insulator 29.

To assemble the coaxial connector according to this embodiment of the present invention, first, the pair of the base plates 23 of the straight-line contact 21 are inserted into the elongated groove 41 of the lower insulator 31 in such a fashion that the projections 43 formed in the elongated groove 41 are fitted between the pair of the base plates 23 and the engaging portions 34 extending from the base plates 23 are fitted into the corresponding depressions 39 formed at the bottom of the elongated groove 41, by which the straight-line contact 21 is prevented from moving in the longitudinal direction of the groove 41 as mentioned previously.

The straight-line contact 21 is then covered with the upper insulator 29 in such a fashion that the support section 35 of the first contact 25 is inserted into the deep and narrow portion of the elongated groove 49 of the upper insulator 29, while the upper portion of the contact 27 is inserted into the wide and shallow portion of the groove 49 as shown in FIG. 6.

As a result, the straight-line contact 21 is supportedly interposed between the upper insulator 29 and the lower insulator 31. The upper insulator 29 and the lower insulator 31 are then mutually engaged and interconnected by a suitable means.

In addition, the ground pin 37 is inserted into the first hole 45 and then contacted by the second contact 27, whereupon the signal pin 47 is inserted in a non-contacting manner between the adjacent first contacts 25. The coaxial contact 33 penetrates the third hole 51 and is inserted between the adjacent first contacts 25. As a result, the outer conductive body of the coaxial cable contact 33 makes contact with the first contact 25 and is therefore connected to the ground pin 37 through the straight-line contact 21. Accordingly, the outer conductive body of the coaxial cable contact 33 is fully grounded. At the same time, an inner conductive body of the coaxial cable contact 33 contacts the signal pin 47.

As can be understood from the foregoing explanation of this embodiment, the first and second contacts of the straight-line contact extend from the base plate thereof and are made integral and the base plate portion is fitted into the lower insulator. Thus unlike the conventional coaxial connector, the end portions of the first contact and the second contact do not constitute free ends. Therefore, the straight-line contact can be easily and accurately fitted into the right position in the lower insulator, without causing the problems such as bending and buckling of the contact as in the conventional straight-line contact when assembling the straight-line contact. Further, when covering the upper insulator, a press fitting which requires a special tool is unnecessary. Accordingly, the assembly of this coaxial connector is simple, quick and free from error.

What is claimed is:

1. In a coaxial connector comprising a first insulator, a second insulator facing said first insulator in a first predetermined direction, a contact member disposed between said first and said second insulators, and guide means for guiding a mating element which is to be connected to said contact member, said first insulator having a first principal surface, said second insulator having a second principal surface which is opposite to said first principal surface in said first predetermined direction, said contact member comprising a first and a second conductive plate which are superimposedly combined, the improvement wherein each of said first and said second conductive plates includes:

a base plate extending in a second predetermined direction which is perpendicular to said first predetermined direction; and a first and a second contact extending from said base plate perpendicular to said second predetermined direction, said first and said second contacts being arranged alternately in parallel rows in said second predetermined direction, said first insulator having, on said first principal surface, a first groove extending in said second predetermined direction, said second insulator having, on said second principal surface, a pair of second grooves extending in said second predetermined direction, said first and said second contacts having end portions which are collectively accommodated in said first groove, each base plate of said first and said second conductive plates being accommodated in each of said second grooves.

2. A coaxial connector as claimed in claim 1, wherein said pair of second grooves formed in said second insulator are separated by a plurality of projections arranged in a row formed between said pair of second grooves, each of said projections being fitted between said pair of said base plates.

3. A coaxial connector as claimed in claim 1, wherein each of said base plates further comprises an engaging portion extending therefrom, each of said second grooves comprises a depression for accommodating said engaging portion of said base plate, thereby preventing said base plate from movement thereof in said second predetermined direction.

4. A coaxial connector as claimed in claim 1, wherein said second insulator has a cylindrical surface defining a hole for insertion of a ground pin, said hole being formed between said pair of second grooves.

5. A coaxial connector as claimed in claim 1, wherein said second insulator has a cylindrical surface defining a hole for insertion of a signal pin, said hole being formed between the adjacent pairs of said second grooves.

6. A coaxial connector as claimed in claim 1, wherein said first and said second contact are resilient, said first contact having a central portion which is bent outward, said second contact having a central portion which is bent inward.

7. A coaxial connector as claimed in claim 1, wherein said second groove comprises a narrow and deep portion and a wide and shallow portion, the end portion of said first contact being fitted into said narrow and deep portion, the end portion of said second contact being fitted into said wide and shallow portion.

8. A coaxial connector as claimed in claim 1, wherein said guide means is a hole formed in said first insulator.

* * * * *